US011045011B2

(12) United States Patent
Venditto et al.

(10) Patent No.: US 11,045,011 B2
(45) Date of Patent: Jun. 29, 2021

(54) APPARATUS, SYSTEM, AND METHOD FOR PROVIDING A CLIMATE CONTROLLED ENVIRONMENT SURROUNDING A BED FOR HEALTHY SLEEP

(71) Applicants: Virgil Venditto, Lake Havasu City, AZ (US); William Latta, Lake Havasu City, AZ (US)

(72) Inventors: Virgil Venditto, Lake Havasu City, AZ (US); William Latta, Lake Havasu City, AZ (US)

( * ) Notice: Subject to any disclaimer, the term of this patent is extended or adjusted under 35 U.S.C. 154(b) by 222 days.

(21) Appl. No.: 16/243,776

(22) Filed: Jan. 9, 2019

(65) Prior Publication Data

US 2020/0214459 A1 Jul. 9, 2020

(51) Int. Cl.

| | |
|---|---|
| ***A47C 19/22*** | (2006.01) |
| ***A47C 21/04*** | (2006.01) |
| ***A47C 31/00*** | (2006.01) |
| ***A47C 21/00*** | (2006.01) |

(52) U.S. Cl.

CPC ..... *A47C 21/044* (2013.01); *A47C 19/22* (2013.01); *A47C 21/003* (2013.01); *A47C 21/048* (2013.01); *A47C 31/008* (2013.01)

(58) Field of Classification Search

CPC ... A47C 21/003; A47C 21/042; A47C 21/044; A47C 21/048; A47C 19/22; A47C 19/022; A47C 31/008

See application file for complete search history.

(56) References Cited

U.S. PATENT DOCUMENTS

| | | | | |
|---|---|---|---|---|
| 2,104,024 A * | 1/1938 | Conbole | F24F 7/06 | 454/251 |
| 2,898,837 A * | 8/1959 | Scarselli | A47C 21/044 | 454/338 |
| 3,101,488 A * | 8/1963 | Peebles | A47C 21/044 | 5/423 |
| 3,511,162 A * | 5/1970 | Truhan | A61G 13/108 | 454/187 |
| 3,724,172 A * | 4/1973 | Wood | A61G 10/02 | 95/287 |
| 3,928,876 A * | 12/1975 | Starr | A47C 21/044 | 5/284 |
| 5,642,539 A * | 7/1997 | Kuo | A47C 21/044 | 5/423 |
| 7,037,188 B2 * | 5/2006 | Schmid | A47C 21/044 | 454/187 |

(Continued)

*Primary Examiner* — David R Hare

(57) ABSTRACT

The present invention is an assembly, system, and methods for enveloping a sleeper in a lower/higher temperature area of filtered and cooled/warmed air to promote a healthy sleeping environment. The invention maintains the environment around the sleeper between a lower temperature and an upper temperature. The invention consists of a hollow platform supporting a mattress, a cooling compressor/heat exchanger and ducting within the platform to mix the incoming and processed air before the air is blown onto the sleeping area through a plurality of louvers in a hollow headboard higher and wider than the sleeping platform. The headboard directs the air over the sleeper such that the sleeper is shielded from higher/lower temperature air in the room containing the invention.

6 Claims, 13 Drawing Sheets

(56) References Cited

U.S. PATENT DOCUMENTS

| | | | | |
|---|---|---|---|---|
| 7,487,646 | B2 * | 2/2009 | Matsushima | A47C 19/005 236/49.3 |
| 7,543,583 | B2 * | 6/2009 | Acton | A47C 21/044 128/200.28 |
| 8,122,540 | B2 * | 2/2012 | Ardis | A47C 21/044 5/423 |
| 9,456,700 | B2 * | 10/2016 | Greener | A47C 21/044 |
| 2003/0033790 | A1 * | 2/2003 | Hague | B01D 46/0023 55/385.1 |
| 2007/0251165 | A1 * | 11/2007 | Kern | A47C 17/52 52/173.1 |
| 2009/0064415 | A1 * | 3/2009 | Payne | A47C 19/126 5/620 |
| 2010/0005588 | A1 * | 1/2010 | Christopher | A47C 21/048 5/423 |
| 2010/0205739 | A1 * | 8/2010 | Gallant | A61G 12/004 5/600 |
| 2013/0031722 | A1 * | 2/2013 | Wong | A47C 21/048 5/423 |
| 2019/0099009 | A1 * | 4/2019 | Connor | A61B 5/0205 |

* cited by examiner

APPARATUS, SYSTEM, AND METHOD FOR PROVIDING A CLIMATE CONTROLLED ENVIRONMENT SURROUNDING A BED FOR HEALTHY SLEEP

FIELD OF INVENTION

The field of invention relates to beds and controlling sleeping environment.

BACKGROUND

While humans prefer a cooler room to sleep in most people are forced by their home heating and cooling system to something less than optimal for sleeping.

Summer time thermostats are generally set to 78-80 because a lower temperature thermostat setting is equated to higher power consumption which equates to high electric bills. Winter time thermostats are generally set to 72 because a higher temperature thermostat setting again is equated to higher power consumption which equates to high electric bills.

The U.S. Department of Energy recommends setting your thermostat to 78 degrees F. (26 degrees C.) when you are home. Setting your air conditioner to this level will allow you to stay cool and avoid an unusually high electricity bill.

Sleep doctors as well as the National Sleep Foundation recommend that the best temperature for sleep should be between 60 and 67 degrees Fahrenheit to help reach "Thermo Neutrality" and to achieve the most restful and restorative sleep possible. Thermostat settings far lower or higher than what's recommended could lead to restlessness and can affect the quality of REM (rapid eye movement) and SWS (slow wave sleep) sleep.

Other cool sleeping methods have been introduced such as gel infused mattresses, blowing ambient air under the mattress coverings or circulating water through the mattress or mattress topper, all of which only slightly affects surface temperatures not the environment.

Men typically like a bedroom that is colder and women typically like a bedroom that is warmer, say 68 to 70 degrees. Most sleep studies have found that 65 is a good compromise temperature. Setting a whole house thermostat to 65 at night during the summer is almost a guarantee that a home air conditioning system set at 65 degrees during the night is going to run all night or close to it. Setting the home heating system to 65 degrees during the night guarantees that come morning, the heading system is going to be running half of the day to bring the temperature of the house up to 70 to 72 degrees which, again results in higher energy bills.

Problem Statement

What is needed is some device or system to control the local environment over and around a bed.

SUMMARY

The instant invention discloses a number of devices, methods, and systems to alleviate most or all problems for persons sleeping where the temperature in the environment is not cool/warm enough for optimum sleep, by maintaining a "Micro Climate/Environment" of cooler/warmer air, over and around the bed system "Thermal Neutrality" of the human body can be achieved much more rapidly by breathing in 60-67 degree air recommended by sleep doctors and sleep scientists.

The air is also continuously filtered which provides significant relief from allergies, asthma and other breathing issues related to pollution and particulates. The air path/circuit also blends and mixes the cold/warm air output from the heat pump with a precise amount of return/processed air from the processed air supply plenum to achieve a delivered temperature set by the thermostat, and creating enough volume of air to completely envelope the entire sleep area creating a controlled "Micro Climate/Environment" over and around the bed system. This bed system also incorporates climate controlled cavities/cabinets for storing CPAP machines, allowing CPAP users the benefit of breathing the cooler/warmer air, to help achieve "Thermal Neutrality"

EMBODIMENTS

Reference will now be made in detail to various embodiments, examples of which are illustrated in the accompanying drawings. Wherever possible, the same reference numbers will be used throughout the drawings to refer to the same or like parts.

Definitions

CPAP: Continuous positive airway pressure. . . . Patients with obstructive sleep apnea treated with CPAP wear a face mask with an air delivery hose during sleep which is connected to a pump (CPAP machine) that forces air into the nasal passages at pressures high enough to overcome obstructions in the airway and stimulate normal breathing.

Thermal Neutrality: a state of thermal balance between an organism and its environment such that bodily thermoregulatory mechanisms are inactive) (Also called thermoneutrality.) The condition in which the thermal environment of a homeothermic animal is such that its heat production (metabolism) is not increased either by cold stress or heat stress. The temperature range in which this minimum occurs is called the zone of thermal neutrality.

Micro Climate/Environment: The climate/environment of a very small or restricted area, especially when this differs from the climate/environment of the surrounding area.

REM: a kind of sleep that occurs at intervals during the night and is characterized by rapid eye movements, more dreaming and bodily movement, and faster pulse and breathing.

SWS: a state of deep usually dreamless sleep that occurs regularly during a normal period of sleep with intervening periods of REM sleep and that is characterized by delta waves and a low level of autonomic physiological activity.

SHORT DESCRIPTION OF THE DRAWINGS

Figure 1A:
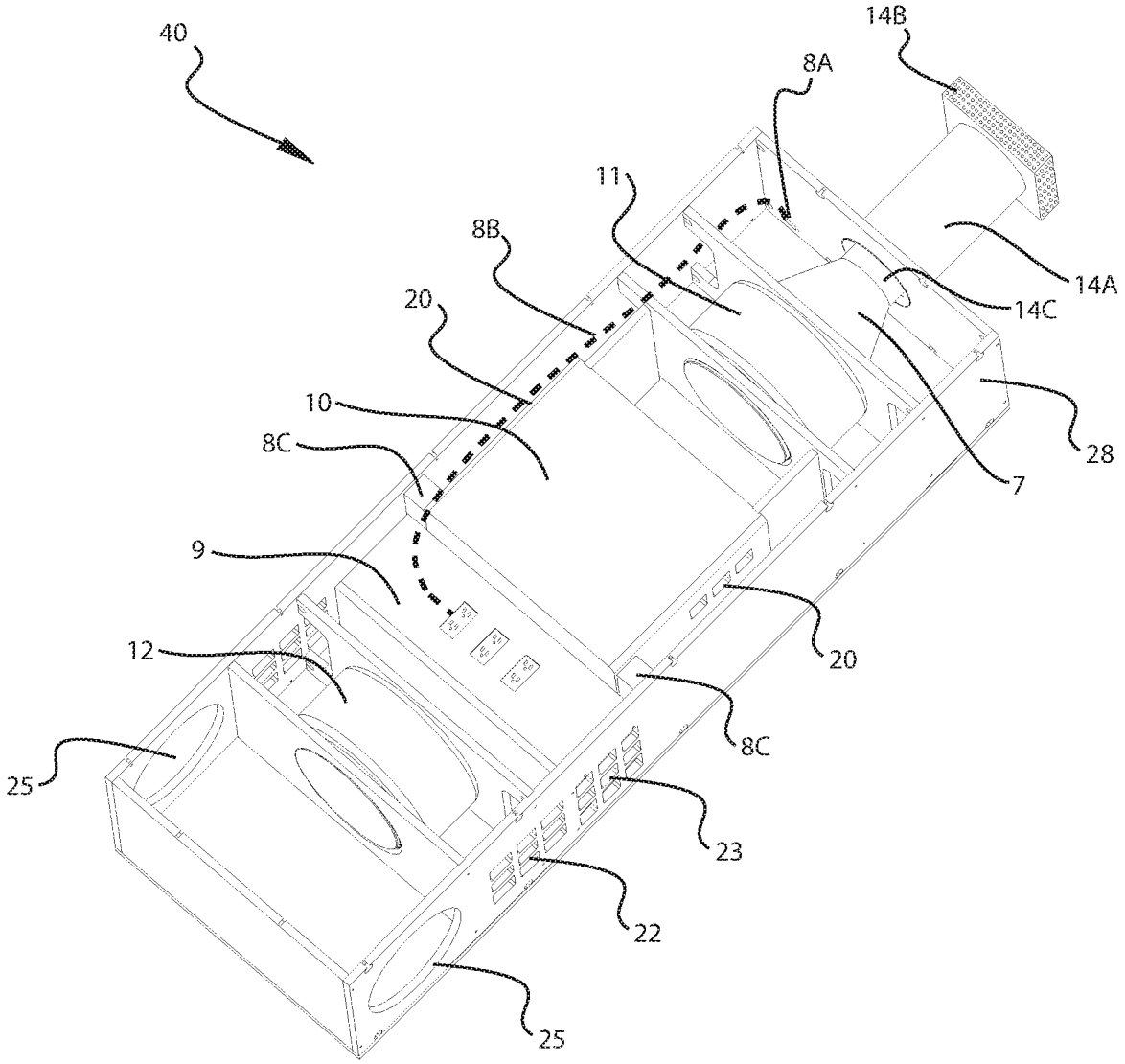
FIG. 1A depicts the heat exchanger and components of the invention including the basic heat pump, fans, electronics and duct assemblies.
Figure 1B:
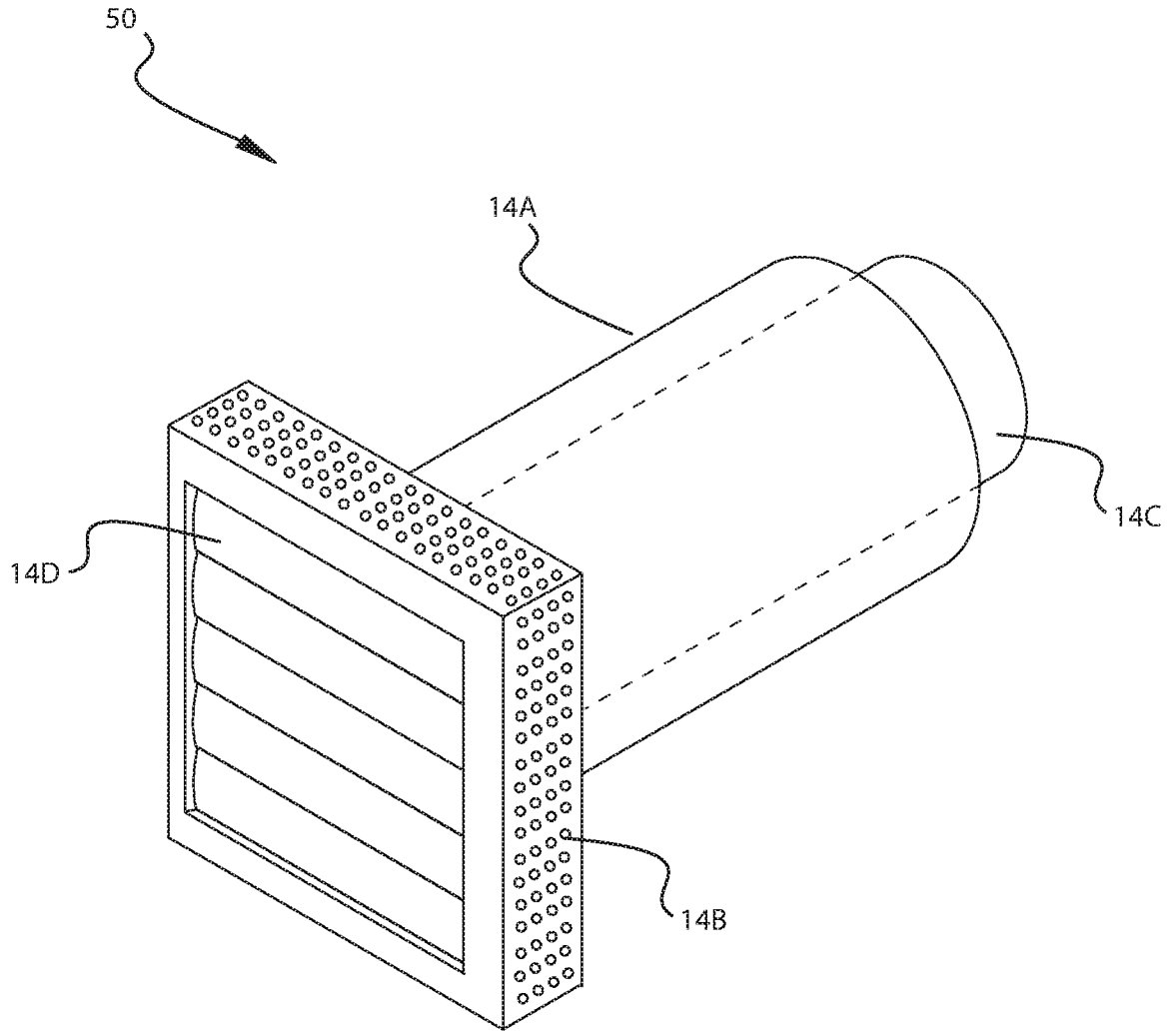

FIG. 1B depicts the hot/cold air exhaust and fresh air intake coaxial duct assembly with all identifying subcomponents which accommodates moving hot/cold air from the heat exchange unit to the outside environment and accommodates the pulling in of fresh air from the outside environment.

Figure 1C:
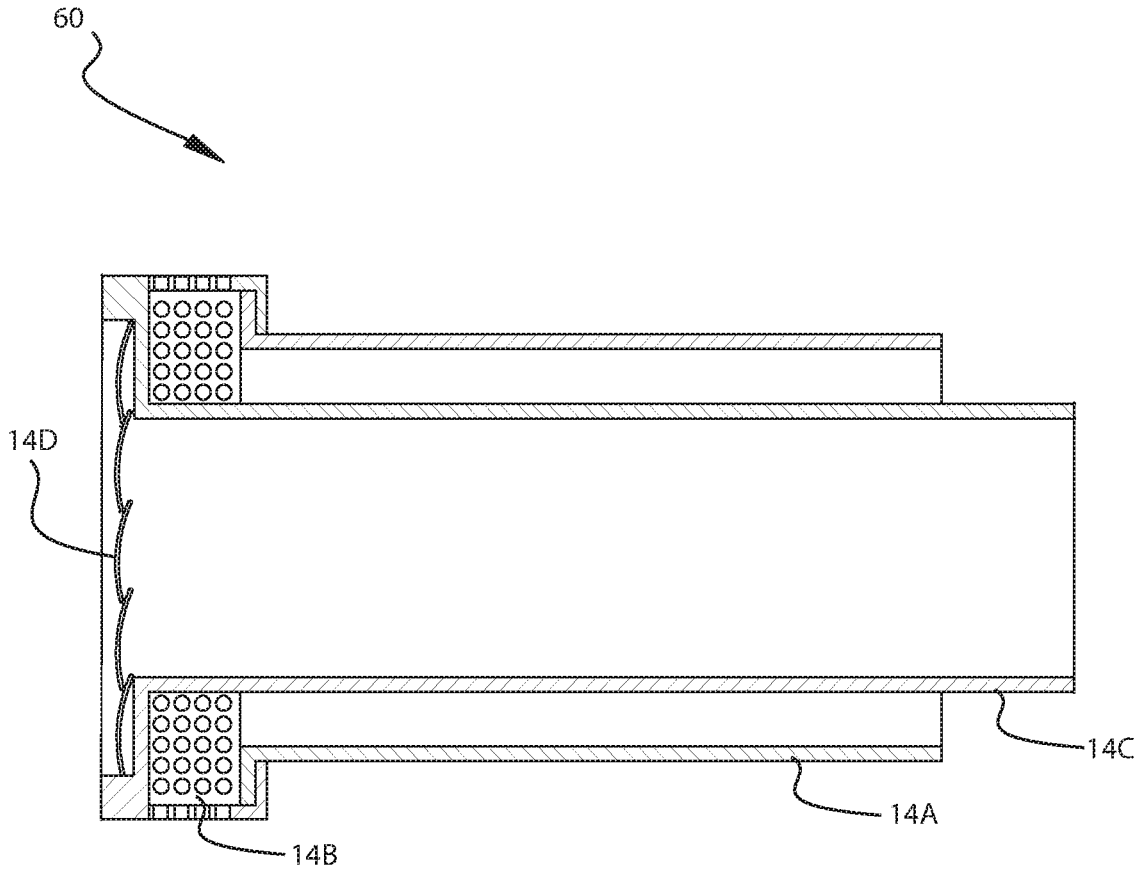

FIG. 1C depicts a side cut away view of the hot/cold air exhaust and fresh air intake assemblies.

Figure 2A:
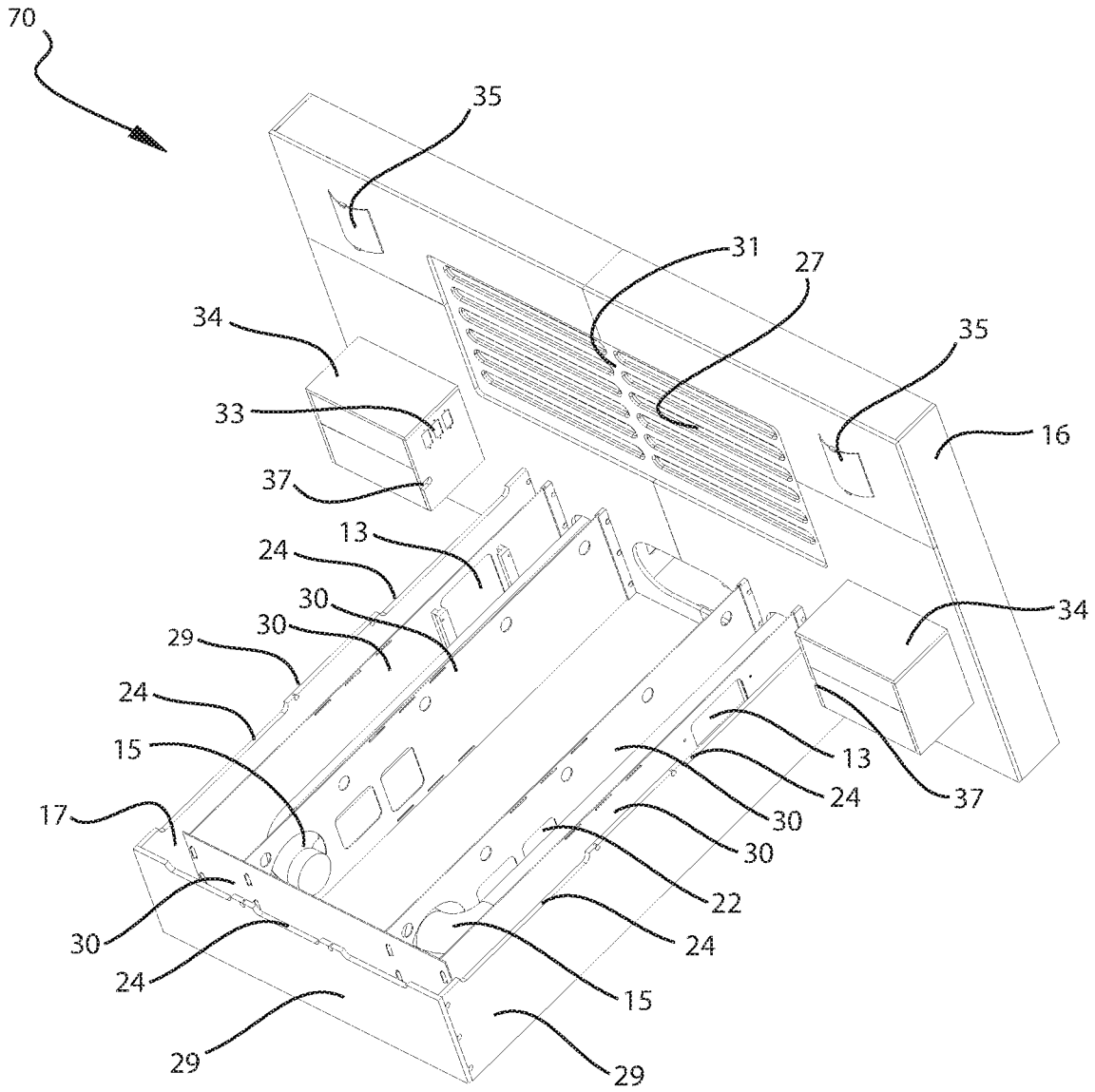

FIG. 2A depicts a view of the internal duct work assemblies for processed air supply and return/recaptured processed air.

Figure 2B:
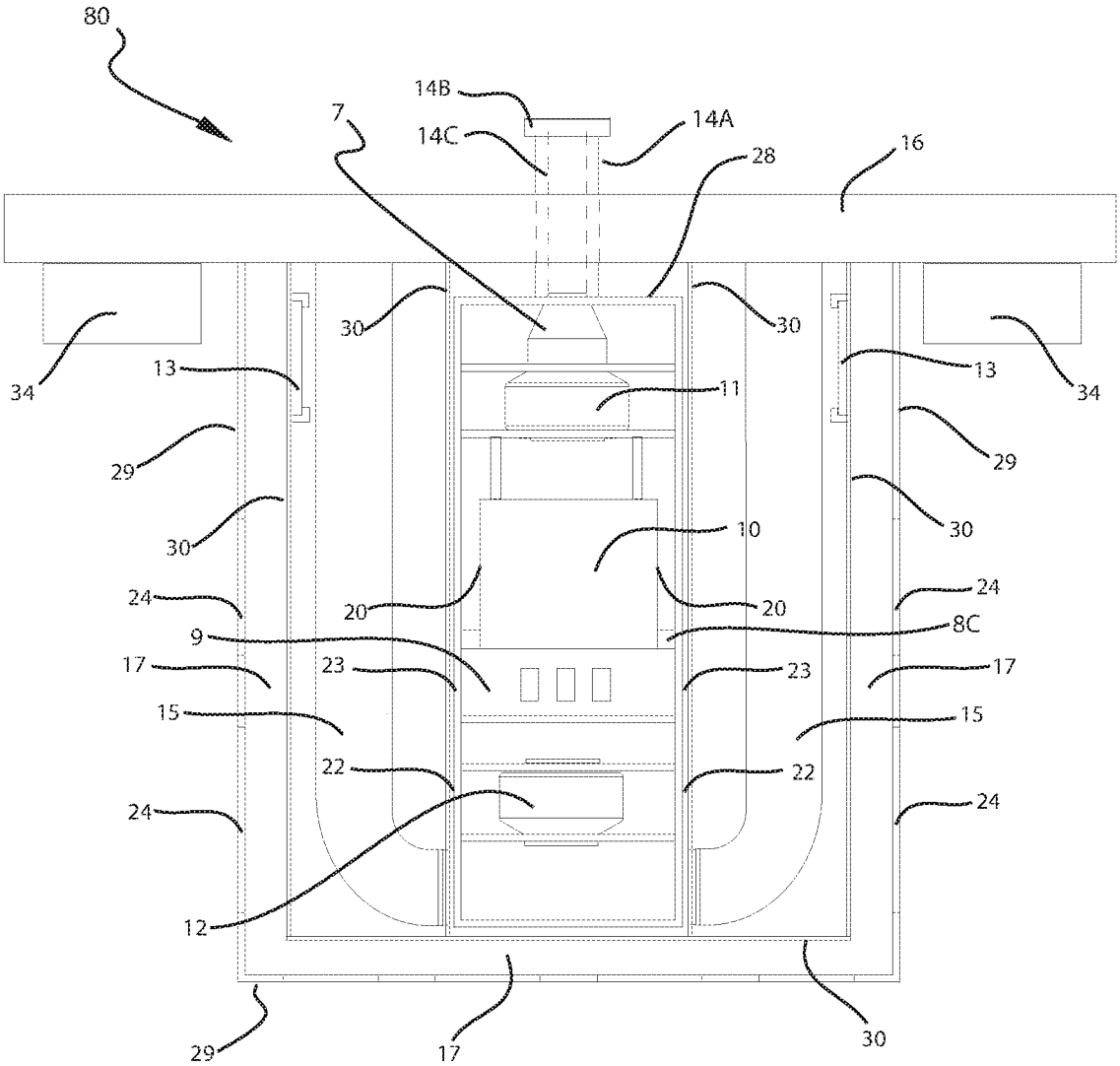

FIG. 2B depicts a top view of the invention showing the ducting assemblies that controls and directs the movement of air through the central assembly of the heat pump, fans, filter, and hot/cold air exhaust and fresh air intake coaxial duct assembly.

Figure 3A:
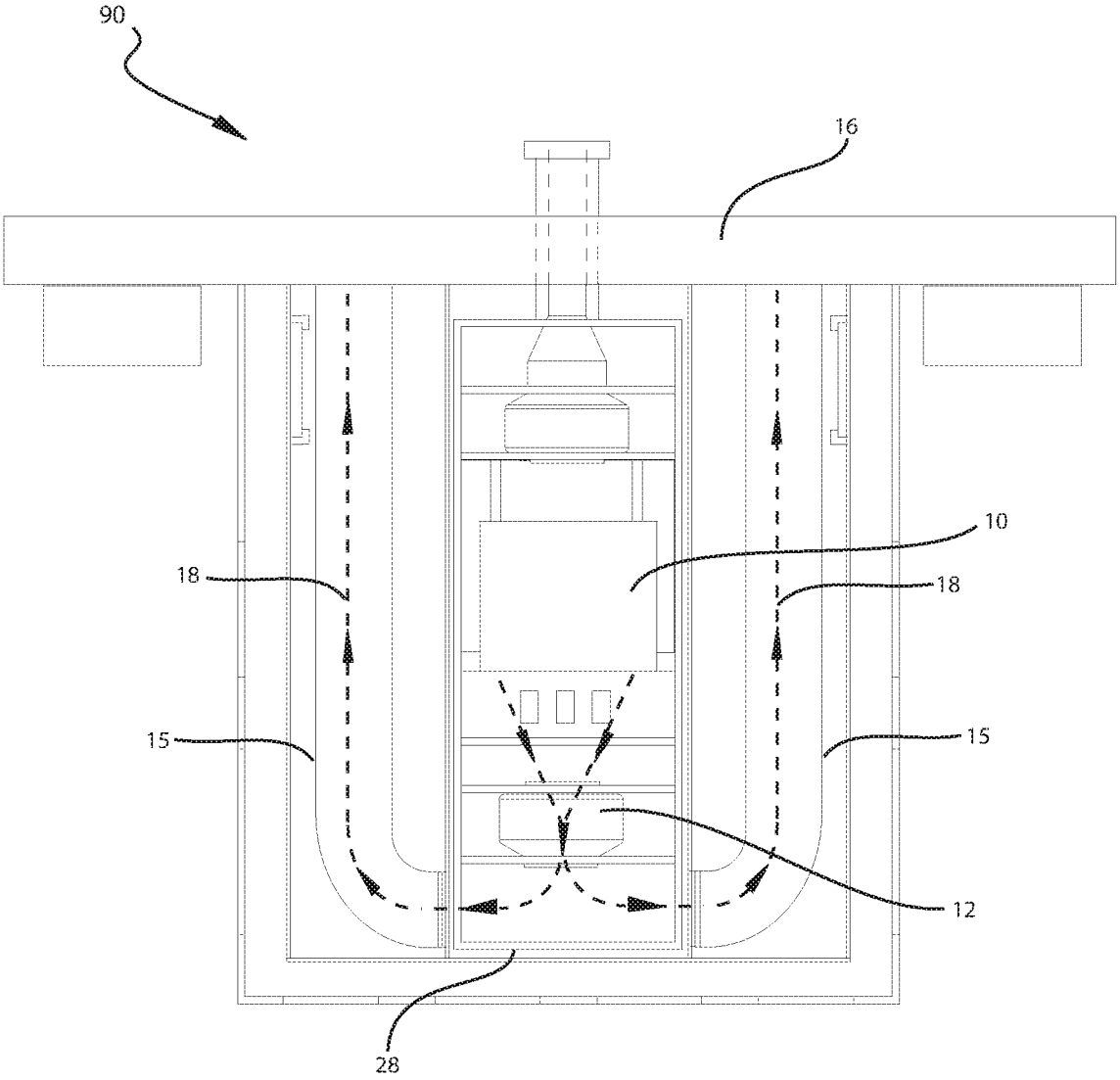

FIG. 3A depicts, through directional arrows, the path of processed air from the heat pump through the fan assembly and into the plenum/headboard.

Figure 3B:
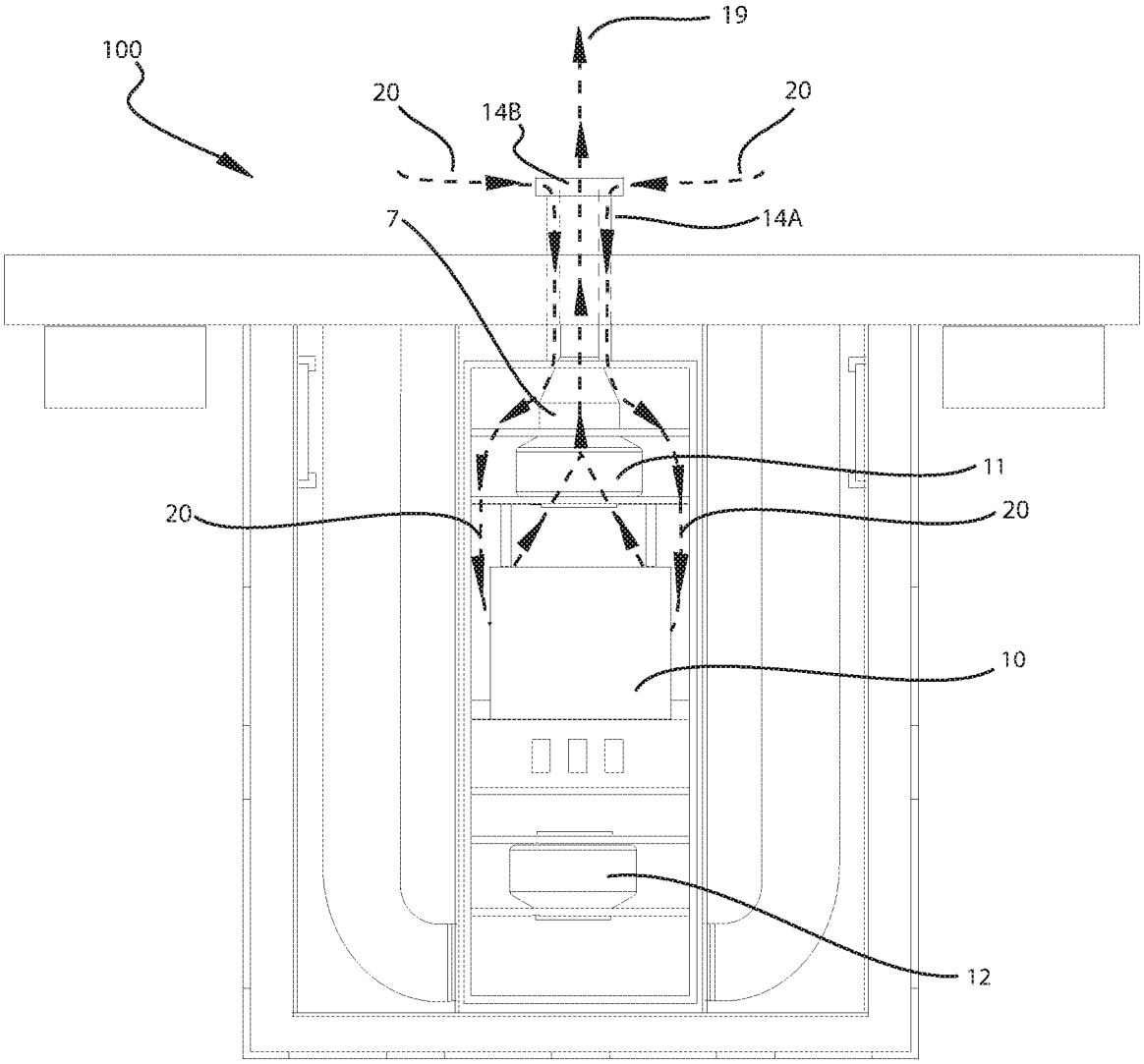

FIG. 3B depicts the hot/cold air exhaust and heat pump showing, through directional arrows, the path of air movement to the outside of house environment and the intake of fresh air from the outside of house environment through the coaxial duct to the heat pump and the coaxial walls that allow a heat exchange between the air being exhausted and the fresh air being pulled into the heat pump.

Figure 3C:
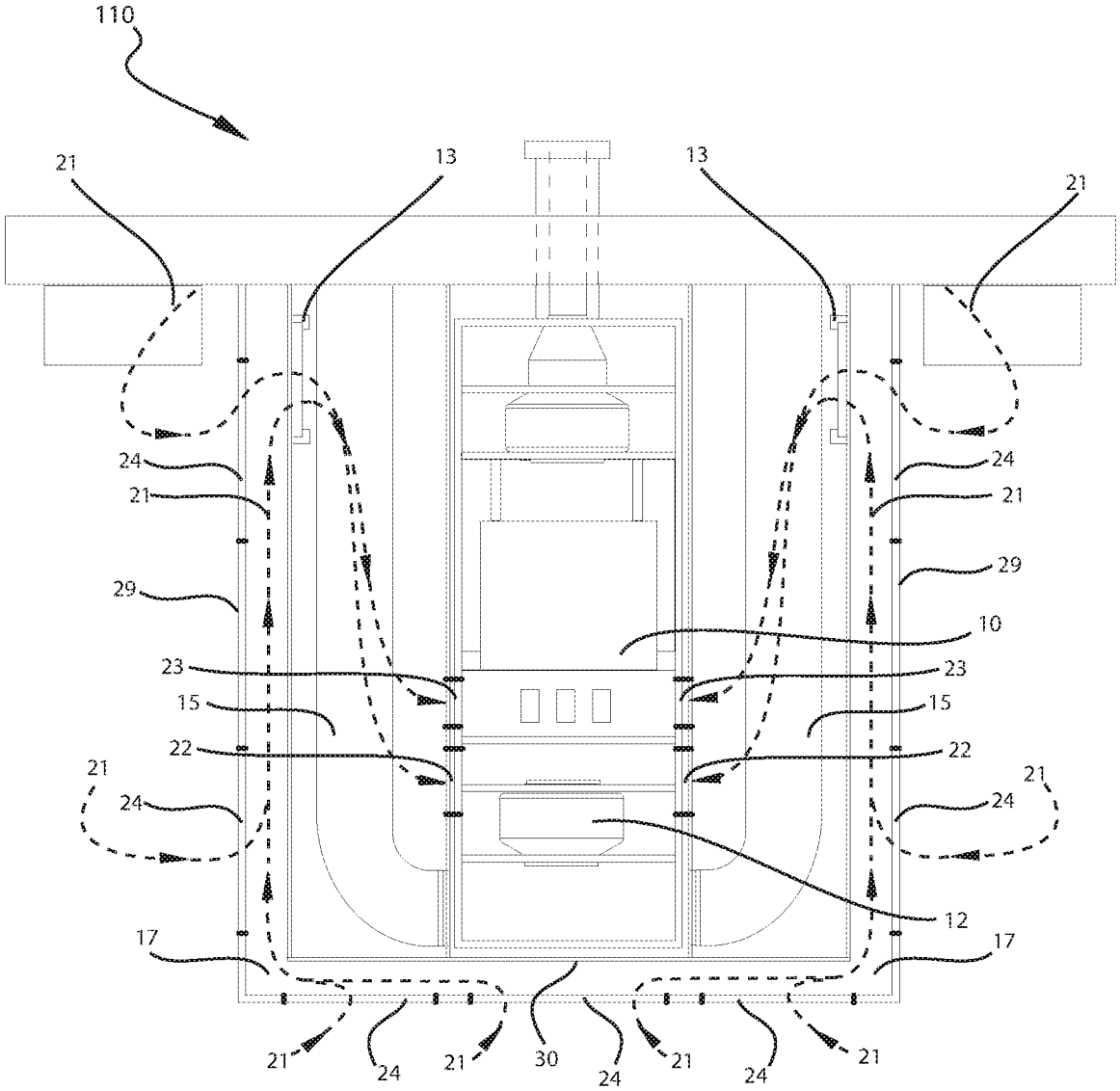

FIG. 3C depicts, through directional arrows, the path of air after exiting from the plenum/headboard and flowing over the bed and captured by and pulled into the ducting structures back to the heat pump.

Figure 4:
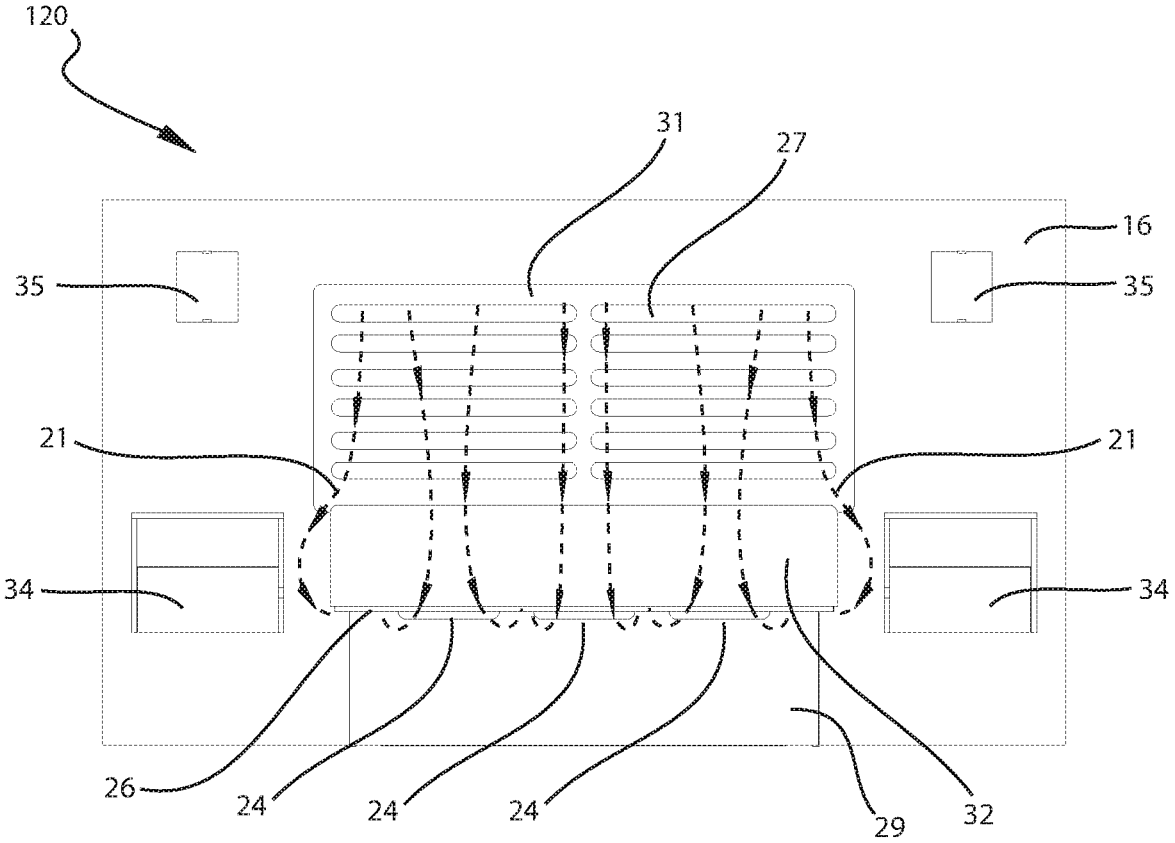

FIG. 4 depicts, through directional arrows, an end view of the flow of air through louvers in the headboard of the bed, down and over the mattress and sleepers and off the bed to be recaptured by the pulling of air through the ductwork into the heat pump. Note the end view of the microenvironment bubble created by the movement of air over the mattress and sleepers and returned/recaptured into vents located on the end of the bed below the mattress.

Figure 5:
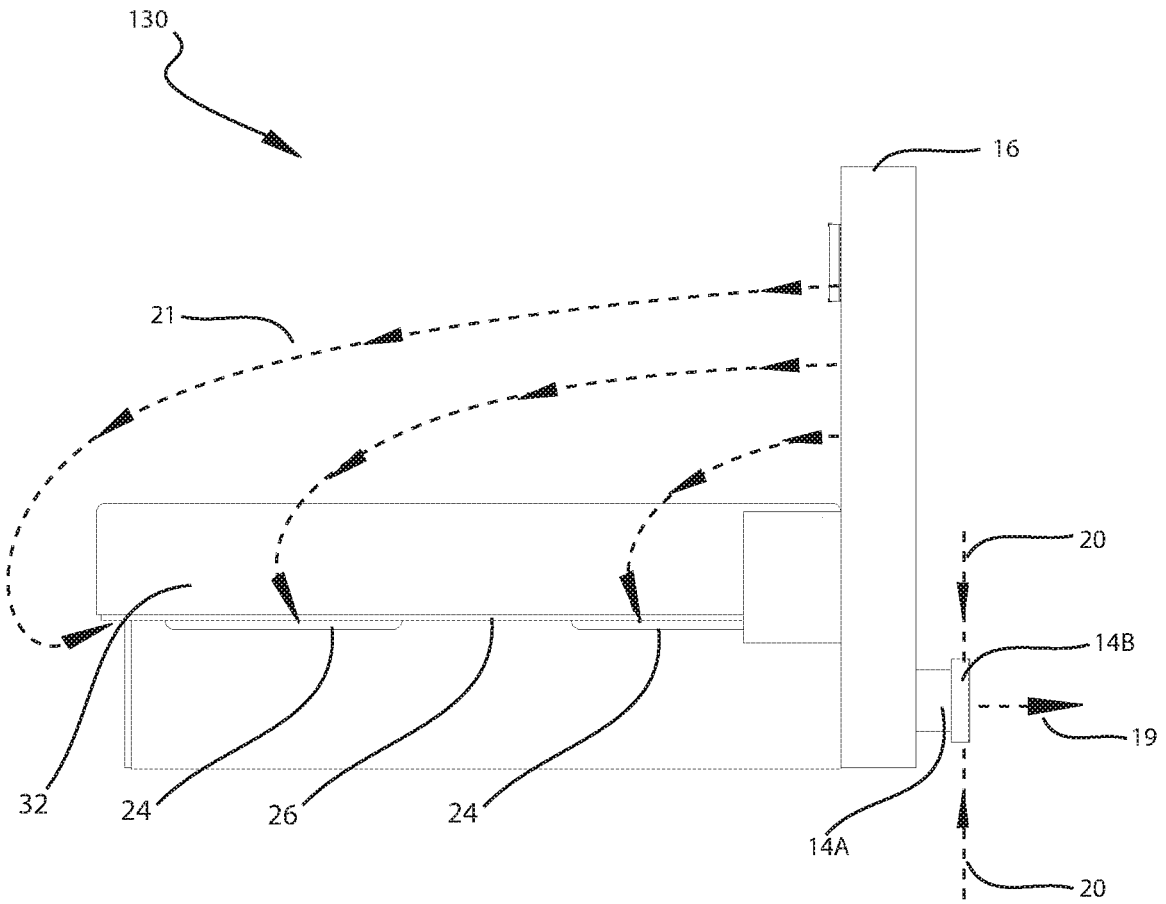

FIG. 5 depicts, through directional arrows, a side view of the flow of air through louvers in the headboard of the bed, down and over the mattress and sleepers and off the bed to be recaptured by the pulling of air through the ductwork into the heat pump. Note the side view of the microenvironment bubble created by the movement of air over the mattress and sleepers and returned/recaptured into vents on the side of the bed below the mattress.

Figure 6:
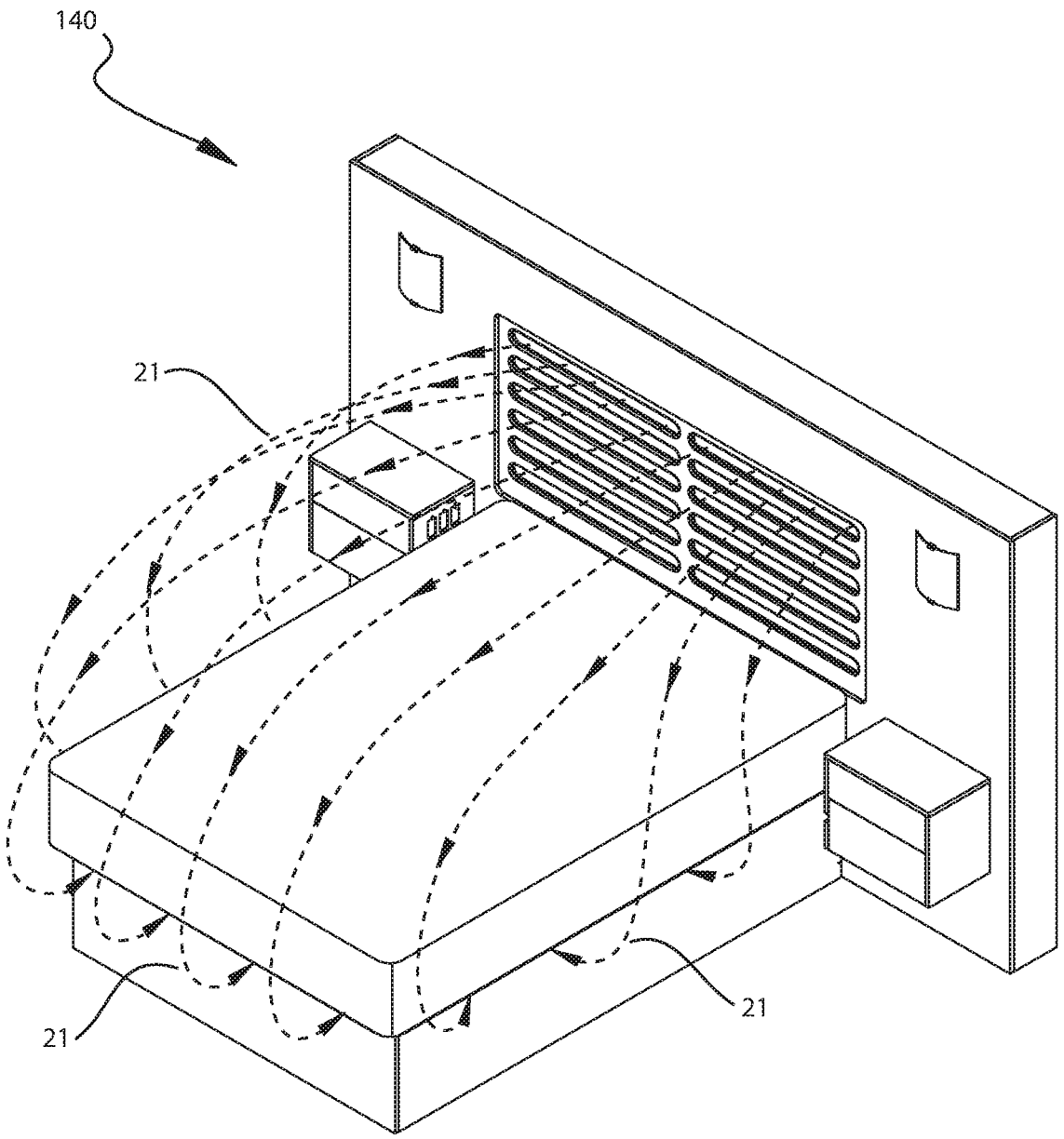

FIG. 6 depicts the outside components of the invention less the central objects shown in FIG. 1. In this depiction, the platform containing the ductwork, the mattress containment, the louvered headboard, lighting fixtures, and attached nightstands/CPAP cabinets. Also depicted through directional arrows, an isometric view of the flow of air through louvers in the headboard of the bed, down and over the mattress and sleepers and off the bed creating the microenvironment bubble by the movement of air over the mattress and sleepers and returned/recaptured into vents on the end and sides of the bed below the mattress.

Figure 7:
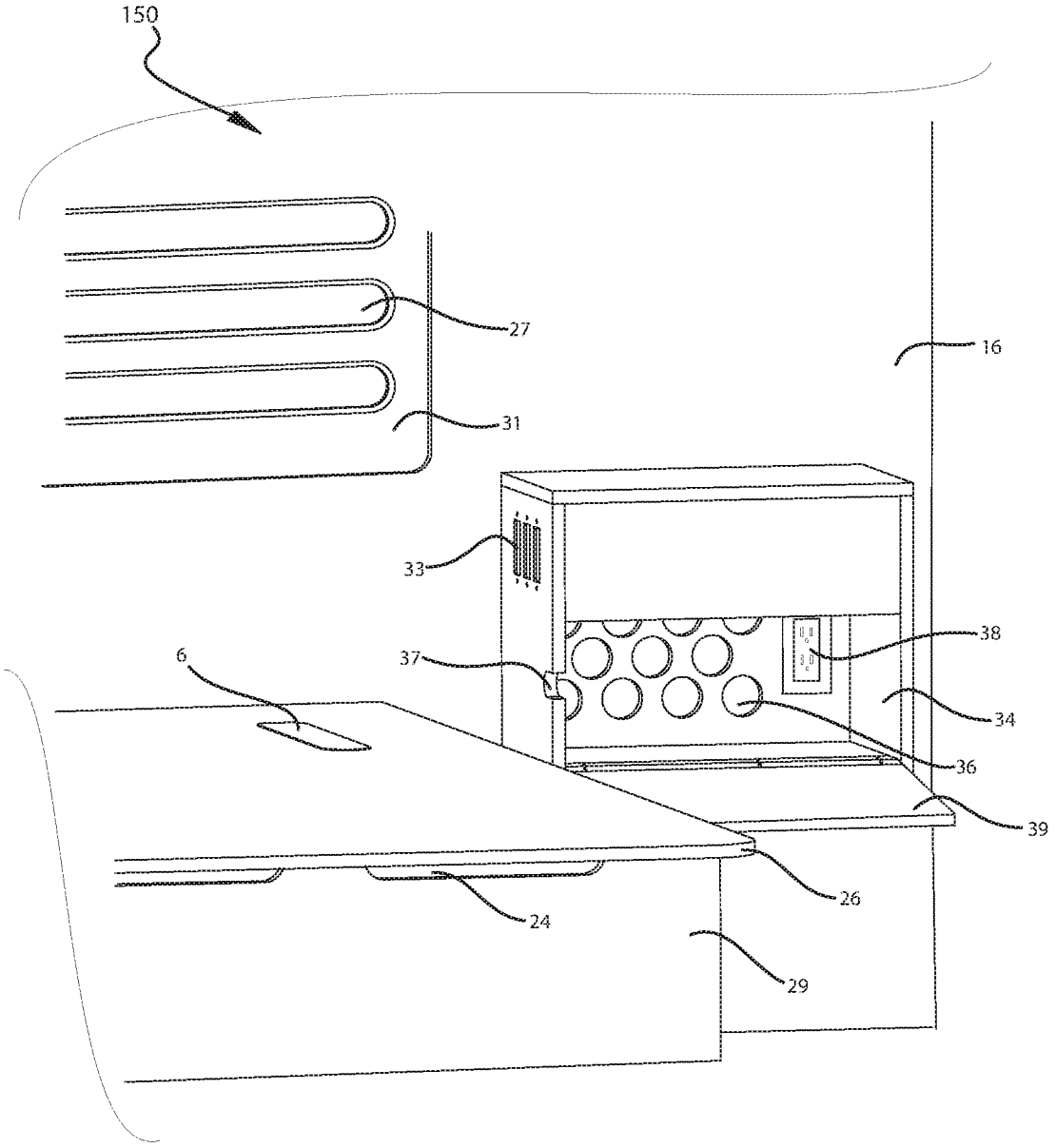

FIG. 7 depicts an isometric view of the nightstand/CPAP cabinet mounted onto the plenum/headboard.

Figure 8:
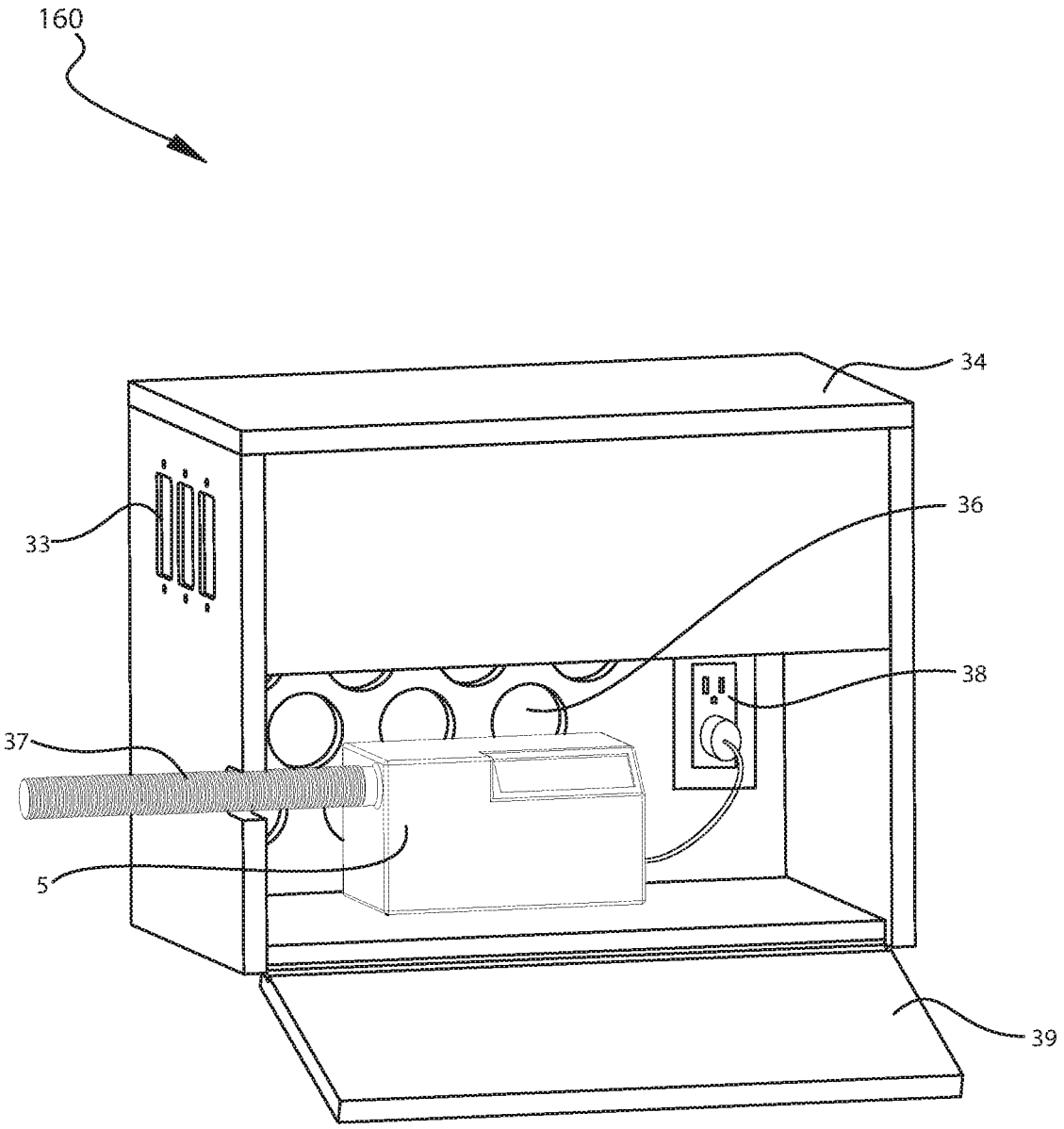

FIG. 8 depicts an isometric interior view of the nightstand/CPAP cabinet showing a CPAP machine with output hose, 120 VAC power receptacle for powering of CPAP machines and ports at the rear of the cabinet which allow processed air to flow into the cabinet delivering processed air to a CPAP machine allowing CPAP users the benefits of the system.

NUMBER LEGEND

5 CPAP Machine
6 Filter Access Port & Cover
7 Exhaust Reducer
8A 120 VAC Input Connector
8B 120 VAC Wiring to Electrical Panel
8C Foam Seal
9 120 VAC Electrical Panel with Under Mounted Wireless Receiver and Electronic Control Components
10 Heat Exchanger/Compressor Unit, Hot & Cold Coils and Fans
11 Variable Speed Exhaust Fan/Hot/Cold Air
12 Variable Speed Processed Air Supply Fan
13 Air Filter Assembly
14A Outside Air Return Tube
14B Outside Air Return Screen
14C Exhaust Air Tube
14D Exhaust Air Louvers
15 Processed Air Supply Duct
16 Processed Air Supply Plenum
17 Processed Return Air Duct
18 Processed Air Supply Path to Plenum
19 Hot/Cold Air Exhaust Path to Outside
20 Fresh Outside Air Return Path to Heat Exchanger
21 Processed Air Output Path From Plenum
22 Processed Air Return to Processed Air Supply
23 Heat Pump Return
24 Processed Air Supply Return Openings
25 Processed Air Supply Output
26 Platform Top (Seals The System)
27 Processed Air Supply Output Velocity Control Screen
28 Air Handling Enclosure (Top Sealing Panel Not Shown)
29 Outside Enclosure Assembly & Mattress Platform Support
30 Inside Enclosure Assembly, Return Air Duct & Mattress Platform Support
31 Headboard Frame Assembly
32 Mattress
33 Control Panel (On/Off, USB Power Output & Light Dimmer)
34 CPAP Processed Air Cabinet
35 Light Fixtures
36 CPAP Cabinet Processed Air Ports
37 CPAP Output Hose
38 CPAP 120 VAC Power Receptacle
39 CPAP Cabinet Sealing Door

EMBODIMENTS

Reference will now be made in detail to various embodiments, examples of which are illustrated in the accompanying drawings. Wherever possible, the same reference numbers will be used throughout the drawings to refer to the same or like parts.

In a first exemplary embodiment an apparatus is disclosed showing the major components of the instant invention. These components are comprised of an electrical control module, a heat pump assembly capable of providing both hot and cold air which is moved by a built in fan assemblies and controlled by a wireless thermostat module. The wireless thermostat is controlled by a remote application running on a smartphone or other handheld wireless device such as a Personal Digital Assistant (PDA), laptop or desktop computer, a handheld remote device communicates with the wireless thermostat module via a communications protocol such as Wifi, Bluetooth, or a propriety protocol, and ducting to exhaust air outside of the house and mix outside air with inside air to keep the air inside the room fresh and at a constant temperature.

In a related embodiment, a system to keep fresh temperature controlled air flowing over a sleeper at a temperature consistent with promoting sound sleep comprising a mattress platform and an assembly below the platform with the assembly comprising a heat pump, fans, ducting, and a remotely controlled thermostat managing the temperature. The system ducting and filtered temperature controlled air designed to flow over the sleepers from the headboard toward the foot of the bed, over the sides and end of the bed and recaptured such that the processed air is continuously recirculated and reintroduced over the sleeper.

In another related embodiment, a method for creating and maintaining a microenvironment around a sleeper such that the microenvironment air is temperature controlled and filtered promoting sound sleep and largely eliminating filterable allergens.

In a second exemplary embodiment an apparatus is disclosed that provides a double walled (coaxial) duct between a heat exchanger and the out of house environment where the double wall heat exchanger exhausts unconditioned air from the heat pump fan through the center channel and pulls untreated air from the outside of house environment through the channel separating the outer wall from the inner channel. This adds or removes heat to the outside of house air being pulled between the walls of the central channel and adds or removes heat from the exhausting air to the outside environment minimizing the impact of exhaust air on the inside environment. The (coaxial) duct system also eliminates a negative indoor pressure environment.

In a related embodiment, attached nightstands/CPAP cabinets (34) are shown. In this depiction, a closed environment for containment of CPAP devices that silence the sound of a CPAP device and provides a cutout through which a CPAP hose to the user can be routed. The CPAP cabinets are ported/louvered at the rear of the cabinet from the plenum/headboard to provide processed air into the cabinet and to the CPAP device.

In a third exemplary embodiment, a control system is disclosed that provides a means for controlling a micro environment surrounding a bed where the temperature of the micro environment is controlled by a wired or wireless control system. This embodiment allows a user to control the temperature of the micro environment through the use of a terminal device containing a control software application.

In a related embodiment, the control software application gives the user the ability to set the temperature of the micro environment and the time over which the micro environment reaches that temperature and the time the temperature of the micro environment is maintained and the time in which the temperature of the micro environment returns to room temperature.

In another related embodiment, the control software application gives the user the ability to set the time of day in which the micro environment is created and the time of day in which the micro environment is turned off and allowed to stabilize to the room temperature.

In yet another related embodiment, the control software application gives the user to ability to accelerate the time in which the micro environment is established and the ability to accelerate the time in which the micro environment is returned to the room temperature.

DETAILED DESCRIPTION OF THE INVENTION

Objects and advantages of the present invention will become apparent to those skilled in the art upon reading this description in conjunction with the accompanying drawings, in which like references and numbers have been used to designate like or analogous elements.

Now referencing FIG. 1A where the components for heating, cooling, and air flow are controlled. In this figure, 40 depicts the assembly containing the components. Component 28 provides the enclosure with vents 22 and 23 providing a return processed air path to the evaporator section contained in heat exchanger/compressor unit 10 and variable speed processed air supply fan 12. Variable speed processed air supply fan 12 is a fan assembly controlled by an electronics module (not shown). Variable speed processed air supply fan 12 pulls cold/hot air from heat exchanger/compressor unit 10 and pressurizes the processed air supply output 25 cavity. Processed air supply output 25 directs the airflow into processed air supply ducts 15 (shown in FIGS. 2A and 2B) carrying the processed air to processed air supply plenum 16 (shown in FIGS. 2A and 2B) and through headboard frame assembly 31 and through processed air supply output velocity control screen 27. Variable speed exhaust fan 11 receives hot/cold air from heat exchanger/compressor unit 10 and forces it into exhaust reducer 7 which carries the hot/cold air being exhausted into exhaust air tube 14C then through exhaust air louvers 14D (FIGS. 1B and 1C). Exhaust air tube 14C and exhaust air louvers 14D (FIGS. 1B and 1C) carry hot/cold exhaust air to be vented to the outside environment external to the room. Outside air return screen 14B and outside air return tube 14A carry fresh outside air to the condenser/evaporator section of heat exchanger/compressor unit 10 through fresh outside air return path to heat exchanger 20. 120 VAC input connector 8A located in the cavity housing 28. Electrical wiring 8B carries electric power from 120 VAC input connector 8A to 120 VAC Electrical Panel 9 through fresh outside air return path to heat exchanger 20 then through foam seal 8C forming the front end of fresh outside air return path to heat exchanger 20 to the underside of 120 VAC electric panel 9.

Now referencing FIG. 1B where 50 depicts the exhaust and intake duct assembly comprising exhaust air tube 14C and exhaust air louvers 14D. These two components carry hot/cold exhaust air from exhaust reducer 7 to the outside environment. Fresh air enters through outside air return screen 14B then into and through outside air return tube 14 A.

Now referencing FIG. 1C where 60 depicts a cut away view of outside air return tube 14A, outside air return screen 14B, exhaust air tube 14C and exhaust air louvers 14D. Note that exhaust air louvers are normally closed at depicted when the system is not venting hot/cold exhaust air to the outside environment. When the system is venting hot/cold exhaust air to the outside environment, the louvers will be open. Also note that exhaust air tube 14C is longer than outside air return tube 14A. This allows exhaust air tube 14C to connect to exhaust reducer 7. Outside air return tube 14A is shorter so as to have a clear unobstructed path to fresh outside air return path to heat exchanger 20.

Now referencing FIG. 2A where 70 is a depiction of supporting panels making up the assembly containing outside enclosure & platform support 29 is connected to processed air supply plenum 16. Outside enclosure & platform support 29 contains on its upper edges multiple cutouts forming processed air return openings 24. These openings capture and carry processed air flowing over mattress 32 (FIGS. 4 and 5) through processed air return openings 24 into processed return air duct 17 formed by walls outside enclosure & platform support 29 and inside enclosure assembly & return air duct & platform support 30. Processed air received into this channel/return air duct through processed air supply return openings 24 moves to and through openings in the inside enclosure assembly return air duct & platform support 30 covered by air filter assemblies 13 which filter particulate matter from the recovered/processed air. Processed air supply duct 15 carries processed air provided by variable speed processed air supply fan 12 to processed air supply plenum 16 to headboard frame assembly 31 through processed air supply output velocity control screen 27. Processed air supply plenum 16 receives processed air from processed air supply duct 15 and expels the processed air over, around and onto mattress 32 (not shown) through openings in headboard frame assembly 31 and processed air supply output velocity control screen 27. Processed air supply plenum 16 supports two light fixtures 35, one each positioned on the left and right front of processed air supply plenum 16. Processed air supply plenum 16 with headboard assembly 31 also support two CPAP processed air cabinets 34 mounted such that the top surface of CPAP processed air cabinets 34 are level with the top of mattress 32 (shown in FIGS. 4 and 5). Each CPAP processed air cabinets 34 has a Control Panel (On/Off, USB Power Output & Light Dimmer) 33 mounted on the side of each CPAP processed air cabinets 34 with the controls facing mattress 32. CPAP processed air cabinets 34 each have a CPAP hose opening 37 on each CPAP processed air cabinets 34 to allow for the output hose from the CPAP machine 5 to exit the CPAP processed air cabinet 34. Housing a CPAP machine 5 within one or both CPAP processed air cabinets 34 quiets the pump noise emitted from a CPAP machine 5 and allows processed air to flow from the processed air supply plenum 16 into the CPAP processed air cabinets 34 delivering processed air to the CPAP machine 5. Processed air supply plenum 16 includes headboard frame assembly 31. Headboard frame assembly 31 contains a plurality of openings covered on the back side of headboard frame assembly 31 with processed air supply output velocity control screen 27. Processed air supply output velocity control screen 27 is a mesh material of cloth or wire fabric whose porosity determines the velocity of air flow through the material and the diffusion and dispersion of the air flow over the mattress 31. The diffusion and dispersion of the air flow exiting processed air supply output velocity control screen 27 may vary by changing the porosity of the material depending upon where the material is located on processed air supply output velocity control screen 27. For example, the porosity of the material may be increased near the top of processed air supply output velocity control screen 27 to facilitate the distance the air flows away from processed air supply output velocity control screen 27 toward the foot of mattress 31 and the porosity of the material may be decreased near the bottom of processed air supply output velocity control screen 27 to slow the exit of the air out of processed air supply output velocity control screen 27 to reduce air velocity and or air noise that may interfere with the sleeper.

Now referencing FIG. 2B where 80 depicts a top view of processed return air duct 17, air handling enclosure 28 (Top Sealing Panel Not Shown), and outside enclosure assembly & platform support 29 along with their associated ducts, electronic, electrical, and other associated assemblies as described below. Outside enclosure assembly & platform support 29 forms the outer wall of the bottom structure. Processed air supply return openings 24 are cutouts at the top surface with outside enclosure assembly & platform support 29. There are two processed air supply return openings 24 on each side of outside enclosure & platform support 29 and three on the bottom end of outside enclosure & platform support 29. Processed air supply return openings 24 on all three sides of outside enclosure & platform support 29 capture and carry processed air flowing over mattress 32 (FIGS. 4 and 5) through processed air supply return openings 24 into processed return air duct 17 formed by walls outside enclosure & platform support 29 and inside enclosure, processed return air duct 17 & platform support 30. Processed air received into this channel through processed air supply return openings 24 moves to and through openings in inside enclosure assembly 30, processed return air duct 17 & platform support 30 covered by air filter assemblies 13 which filter particulate matter from the recovered air before it is drawn into the heat exchanger/compressor unit 10 through heat pump return 23 and also pulled into the intake side of the variable speed processed air supply fan 12 through processed air return to processed air supply 22 and mixed with re-processed air. Air handling enclosure 28 receives processed air pressurized by variable speed processed air supply fan 12 and ducts this air via processed air supply ducts 15 for left and right sides to processed air supply plenum 16 and headboard frame assembly 31. Fresh air is pulled into heat exchanger/compressor unit 10 through outside air return tube 14A. Exhaust air tube 14C carries hot/cold exhaust air to be vented to the outside environment external to the room and house containing the components inside air handling enclosure 28. Outside air return tube 14A carries fresh outside air to the condenser section of heat exchanger/compressor unit 10 through vents fresh outside air return path to heat exchanger 20. Variable speed exhaust fan 11 pulls hot/cold air from the condenser section of heat exchanger/compressor unit 10. Variable speed exhaust fan 11 pressurizes this air and sends it through exhaust reducer 7 into exhaust air tube 14C to the outside environment. Processed air supply plenum 16 supports CPAP processed air cabinets 34 attached to left and right sides of processed air supply plenum 16.

Now referencing FIG. 3A where 90 depicts the path of processed air from the evaporator section of heat exchanger/compressor unit 10 to processed air supply plenum 16 with headboard frame assembly 31. In this depiction, variable speed processed air supply fan 12 pulls air that has passed over condenser/evaporator coils in heat exchanger/compressor unit 10 and pressurizes the processed air in air handling enclosure 28. Air handling enclosure 28 exhausts the pressurized air into processed air supply ducts 15 on either side of air handling enclosure 28 processed air supply ducts 15 duct the processed air into processed air supply plenum 16 and headboard frame assembly 31.

Now referencing FIG. 3B where 100 depicts the path of hot/cold air 19 being exhausted from the invention to the outside environment and the path of fresh air 20 from the outside environment into the invention. In this depiction, hot/cold air 19 is pulled from the condenser section of heat exchanger/compressor unit 10 by variable speed exhaust fan 11, pressurizes the hot/cold air 19 and sends it to exhaust reducer 7. Exhaust reducer 7 directs the pressurized hot/cold air 19 into exhaust air tube 14C. Exhaust air tube 14C carries the hot/cold air 19 to exhaust air louvers 14D to the outside environment. The intake side of variable speed exhaust fan 11 also pulls fresh air from the outside environment through outside air return screen 14B and into outside air return tube 14A and back to heat exchanger.

Now referencing FIG. 3C where 110 depicts the processed air return path from processed air supply plenum 16 and headboard frame assembly 31 to heat exchanger/compressor unit 10. In this depiction, processed air expelled from processed supply plenum 16 to headboard frame assembly 31 and through processed air supply output velocity control screen 27 and flows over mattress 32 (not shown) and is captured through processed air supply return openings 24. Variable speed supply fan 12 reduces the air pressure at its intake end which pulls air from inside enclosure assembly 30 which pulls air through air filter assemblies 13 from processed return air duct 17 which reduced air pressure pulls processed return air through processed air supply return openings 24. Variable speed processed air supply fan 12 also pulls air from inside enclosure assembly 30 through processed air return to processed air supply 22 into the condenser section of heat exchanger/compressor unit 10.

Now referencing FIG. 4 where 120 depicts an end view of mattress 32, processed air supply plenum 16 and headboard frame assembly 31, processed air supply return openings 24, and outside enclosure assembly & platform support. In this depiction, processed air output path 21 (shown by directional arrows) from processed air supply output velocity control screen 27 to processed air supply return openings 24 is shown depicting the end view of the microenvironment covering mattress 32. In this depiction processed air flowing out of processed air supply plenum 16 and headboard frame assembly 31 through processed air supply output velocity control screen 27 flows down and over and around the sides and end of mattress 32. The processed air, after flowing over mattress 32 is captured via processed air supply return openings 24 and conveyed back to heat exchanger/compressor unit 10.

Now referencing FIG. 5 where 130 depicts a side view of mattress 32, outside enclosure & platform support 29, processed air return openings 24, and processed air supply plenum 16. In this depiction, processed air output path 21 from processed air supply output velocity control screen 27 to processed air supply return openings 24 is shown depicting the side view of the microenvironment covering mattress 32. In this depiction, processed air flowing out of processed air supply plenum 16 through processed air supply output velocity control screen 27 flows down and over the sides and end of mattress 32. The processed air, after flowing over mattress 32 is captured via processed air supply return openings 24 and conveyed back to heat exchanger/compressor unit 10 which then continues to recirculate the processed air through the system creating a microenvironment over and around the mattress 32.

Now referencing FIG. 6 where 140 depicts processed air output path 21 from processed air supply plenum 16 through processed air supply output velocity control screen 27 to processed air supply return openings 24 (not shown) is depicting the overall view of the microenvironment covering mattress 32.

Now referencing FIG. 7 where 150 depicts an isometric view of the CPAP processed air cabinet 34 mounted onto the processed air supply plenum 16. In this figure, Control Panel (On/Off, USB Power Output & Light Dimmer) 33 contains one three position switch control the heat pump, supply fan, and exhaust fan, one switch to control and dim light fixtures 35, and at least one USB receptacle to provide power to USB devices. Other configures of switches and receptacles are possible. Also shown in this figure is the interior of CPAP processed air cabinets 34 are a plurality of openings CPAP cabinet processed air ports 36 at the back of the cabinet into the hollow interior of the processed air supply plenum 16. The number of the plurality of openings may vary. Also shown in this figure is a electrical receptacle 38 providing a power source for CPAP machine 5 (shown in FIG. 8) and an opening in the side of the CPAP Cabinet to allow CPAP output hose 37 (shown in FIG. 8) connected to CPAP machine 5 and to a user's CPAP mask (not shown). Also shown in this figure is Filter Access Port and Cover 6. This port allows access to Air Filter Assembly 13. This access port allows a user to pull the head of the mattress 32 (not shown) toward the foot of the platform uncovering the port. This facilitates changing of the filter.

Now referencing FIG. 8 where 160 depicts an isometric interior view of the CPAP processed air cabinet 34 showing a CPAP machine 5 with CPAP output hose 37, CPAP 120 VAC power receptacle 38 for powering of CPAP machine 5 and a plurality of CPAP cabinet processed air ports 36 at the rear of the cabinet which allow processed air from the processed air supply plenum 16 to flow into CPAP processed air cabinet 34 delivering processed air to a CPAP machine 5. CPAP machine 5 is shown connected to CPAP hose 37 which in turn is connected to a CPAP mask (not shown). The back interior of CPAP processed air cabinet 34 is shown with a plurality of openings that open into the interior of processed air supply plenum (hollow headboard).

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the embodiments disclosed herein, may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. The processor can be part of a computer system that also has a user interface port that communicates with a user interface, and which receives commands entered by a user, has at least one memory (e.g., flash memory or other comparable storage, and random access memory) that stores electronic information including a program that operates under control of the processor and with communication via the user interface port which may be a wired or wireless port.

A processor may also be implemented as a combination of computing devices, e.g., a combination of a DSP and a microprocessor, a plurality of microprocessors, one or more microprocessors in conjunction with a DSP core, or any other such configuration. These devices may also be used to select values for devices as described herein.

The steps of a method or algorithm described in connection with the embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM) or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. The memory storage can also be rotating magnetic hard disk drives, optical disk drives, or flash memory based storage drives or other such solid state, magnetic, or optical storage devices. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. The computer readable media can be an article comprising a machine-readable non-transitory tangible medium embodying information indicative of instructions that when performed by one or more machines result in computer implemented operations comprising the actions described throughout this specification.

Operations as described herein can be carried out on or over a website. The website can be operated on a server computer, or operated locally, e.g., by being downloaded to the client computer, or operated via a server farm. The website can be accessed over a mobile phone or a PDA, or on any other client. The website can use HTML code in any form, e.g., MHTML, or XML, and via any form such as cascading style sheets ("CSS") or other.

Also, the inventor intends that only those claims which use the words "means for" are intended to be interpreted under 35 USC 112, sixth paragraph. Moreover, no limitations from the specification are intended to be read into any claims, unless those limitations are expressly included in the claims. The computers described herein may be any kind of computer, either general purpose, or some specific purpose computer such as a workstation. The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

We claim:

1. A system to create and maintain a microenvironment contained around an area of a bed mattress to keep a temperature within a controlled temperature range comprising:

a first mattress, and
a hollow platform supporting said first mattress, and
a first heat pump,
a first air stream, and
said first heat pump has a first heat pump input and a first heat pump output, and
a first heat exchanger, said first heat exchanger has a first heat exchanger input and a first heat exchanger output, and
a first heat exchanger output air output, and
a first outside environment air intake, and
a first heat exchanger environment air output, and
a first hollow headboard with inlet openings to receive a stream of a first processed air stream of temperature-controlled air, and
a first supply fan, and
a first supply fan intake end, and
a first supply fan output end, and
a first exhaust fan, and
a first exhaust fan intake end, and
a first exhaust fan output end, and
a first Continuous Positive Airway Pressure (CPAP) processed air and sound suppression cabinet, and
a first bidirectional duct to allow a bidirectional flow of air, and
a first wireless control module;
said hollow platform:
composed of a first outer box and a set of three adjacent inner boxes positioned inside a perimeter of said first outer box composed of a first hollow platform left side wall, a first hollow platform right side wall, a first hollow platform end wall, and said first hollow headboard positioned opposite to said first hollow platform end wall wherein a first set of first three adjacent boxes are composed of a first left-side box, a first right-side box, and a first center box, said first center box contains a first outside environment air return section and a first processed first processed section, and said first bidirectional duct:

comprising a first bidirectional duct inner tube with a first bidirectional duct inner tube input end and a first bidirectional duct inner tube output end, and said first bidirectional duct inner tube conducts output air through said first heat exchanger output through said first bidirectional duct inner tube to a first outside environment and a first bidirectional duct outer tube with a first bidirectional duct outer tube input end and a first bidirectional duct outer tube output end, and said first bidirectional duct outer tube conducts air from said first outside environment to said first outside environment air return section in said first center box, and, said first bidirectional duct passes through said first hollow headboard from said first center box to said first outside environment;

said first hollow headboard:

constructed of a hollow headboard back side and a hollow headboard front side, a hollow headboard bottom side and a hollow headboard top side, and a hollow headboard left side and a hollow headboard right side and, a hollow headboard left side duct opening receiving a first left side duct and a hollow headboard right side duct opening receiving a first right side duct and said first left side duct and said first right side duct conducting said first processed air stream of temperature-controlled air from said first center box, and said hollow headboard front side contains a plurality of openings covered with a screening fabric where a weave of said screening fabric determines a porosity of said screening fabric thereby controlling a velocity of air flowing out of said hollow headboard front side, and a first center box left side duct opening and a first center box right side duct opening, and a first left-side box with a left side duct tube encased and a right-side box with right side duct tube encased, and said first left-side box with said left side duct tube communicably coupling said first center box left side duct opening to said hollow headboard left side duct opening, and said first right-side box with said right side duct tube communicably coupling said first center box right side duct opening to said hollow headboard right side duct opening, and said first left-side box with said left side duct tube encased and said first right-side box with said right side duct tube encased which conveys said first processed air of temperature-controlled air to said first hollow headboard and out said openings on said hollow headboard front side and flowing down over said first mattress to a floor, and said first processed air of temperature-controlled air becoming a first return air upon exiting said first hollow headboard and at least one opening on said first hollow headboard directly behind mounting points for said first CPAP processed air and sound suppression cabinet to provide filtered air to a first CPAP machine, said first CPAP processed air and sound suppression cabinet mutes sound of a motor and pump contained within said first CPAP machine, and an opening on a side surface or a bottom surface of said first CPAP processed air and sound suppression cabinet through which a supply hose from said first CPAP machine is routed to a first CPAP mask used by a first user;

said first wireless control module:

controls said first supply fan and said first exhaust fan, and said first wireless control module is controlled over a wireless link by the first user through software programs executing on cell phones, PDAs, computer tablets, laptop computers, desktop computers, and other computing devices and, said wireless link uses Wifi IP protocol, Bluetooth protocol, or any other proprietary protocol for communications and transferring of data, and said first wireless control module controls said first heat pump and said first exhaust fan thereby maintaining the temperature of said first processed air of temperature-controlled air being sent from said first supply fan to said first hollow headboard within a range of a lower air temperature and an upper air temperature, and said first wireless control module controls a start time of said first heat pump and said first supply fan and said first exhaust fan and a stop time of said first heat pump and said first supply fan and said first exhaust fan, and said first wireless control module turns-on said first heat pump and said first supply fan and said first exhaust fan when commanded to tum-on said first heat pump and said first supply fan and said first exhaust fan when said first user sends a tum-on command to said first wireless control module, and said first wireless control module, turns-off said first heat pump and said first supply fan and said first exhaust fan when commanded to turn-off said first heat pump and said first supply fan and said first exhaust fan when said first user sends a turn-off command to said first wireless control module, even if said turn-off command is received during a time when said first heat pump and said first supply fan and said first exhaust fan are turned-on;

said first supply fan:

is controlled by said first wireless control module, and said first supply fan intake end lowers air pressure between said first supply fan intake end and said first heat exchanger output air output, and said first supply fan intake end pulls a first air return stream through said first heat exchanger, and said first supply fan output end raises air pressure between said first heat pump and a first center box left side duct tube and a first center box right side duct tube allowing said first processed air of temperature-controlled air to flow through said first center box left side duct tube and said first center box right side duct tube to said first hollow headboard;

said first exhaust fan:

is controlled by said first wireless control module, and said first exhaust fan intake end lowers air pressure between said first exhaust fan intake end and said first heat exchanger output pulling said outside environment air from said first outside environment air return section through said first heat exchanger input and into said first heat exchanger to said first heat exchanger output and to said first exhaust fan output end, said first exhaust fan output end raises air pressure between said first exhaust fan output end and said first bidirectional duct inner tube input end conducting said air from said first heat exchanger output to said first outside environment, and said first bidirectional duct:

comprising a first bidirectional duct inner tube with a first bidirectional duct inner tube input end and a first bidirectional duct inner tube output end, and said first bidirectional duct inner tube conducts said first heat exchanger environment air output through said first bidirectional duct inner tube to said first outside environment and, and a first bidirectional duct outer tube with a first bidirectional duct outer tube input end and a first bidirectional duct outer tube output end, and said first bidirectional duct outer tube conducts air from said first outside environment to said first outside environment air return section in said first center box, and said first bidirectional duct passes through said first hollow headboard from said first center box to said first outside environment.

2. The system of claim 1 whereby said first hollow platform left side wall, first hollow platform right side wall, and first hollow platform end wall have a plurality of cutouts along a top edge of said first hollow platform left side wall, first hollow platform right side wall, and first hollow platform end wall to provide a return air path into a duct area between said first outer box and a first left side of said first left-side box and a first right side of said first right-side box and said first center box and, said first left-side box and said first right-side box have an opening on said hollow platform left side of a left side wall of said left-side box and a right side of said first right-side box, both said first left-side box and said first right-side box have a filter assembly to filter air pulled into said said first right-side box through cutouts on the top of said outer box, said filter assembly filters air drawn into said side boxes through said outer box, said filtered air is pulled to said first heat pump by said first supply fan said intake end.

3. A method for controlling a flow of processed air over a mattress of a user creating and controlling a microenvironment whose temperature is different than the temperature of a sleeping area comprising:

a first mattress, and a first sleeping area and a first bidirectional duct, and a first heat pump with a first heat pump input end and a first heat pump output end, and a first heat exchanger, and a first heat exchanger input end, and a first heat exchanger output end, and a first supply fan with a first supply fan intake end and a first supply fan output end, and a first exhaust fan, and a first exhaust fan intake end, and a first exhaust fan output end, and a first wireless control module, supporting said first mattress on a first hollow platform affixed to a first hollow headboard, and said first hollow platform composed of a first hollow platform outer box and three adjacent boxes positioned inside a perimeter of a first hollow platform outer box composed of a first hollow platform left side wall, a first hollow platform right side wall, and a first hollow platform end wall wherein said three adjacent boxes are composed of a first left side box, a first right side box, and a first center box, and said first center box contains said first heat pump, said first supply fan, and said first exhaust fan, sending a first processed air received at said first supply fan intake end from said first heat pump output end into a first pressurized chamber at one end of said first center box, said first pressurized chamber is pressurized by said first supply fan output end with said first processed air from said first heat pump, and a first heat exchanger with a first heat exchanger input end and a first heat exchanger output end;

introducing said first processed air into a first left side air duct and a first right side air duct attached to said first pressurized chamber through a first pressurized chamber left side opening and a first pressurized chamber right side opening;

conveying said first processed air into a first hollow headboard through a first left side headboard opening and through a first right side headboard opening between said first hollow headboard and said first left side air duct and said first right side air duct attached to said first hollow headboard;

said first processed air flows out of said first hollow headboard through a plurality of openings in said first hollow headboard positioned on said first hollow headboard above and across an area higher than said first mattress and, a velocity of said first processed air flowing out of said first hollow headboard through said plurality of openings in said first hollow headboard is controlled by a mesh fabric covering said plurality of openings in said first hollow headboard in which a density of said mesh fabric determines a porosity of said mesh fabric thereby controlling an amount of said first processed air allowed through said mesh fabric and said first hollow headboard;

said first processed air flowing out of said first hollow headboard through said plurality of openings flows over said first mattress maintaining a controlled environment in said first sleeping area and downward to a floor;

passing a portion of said first processed air in said first hollow headboard through an opening to a first cabinet mounted on a front surface of said first hollow headboard, delivering said first processed air to said first cabinet intended to contain a Continuous Positive Airway Pressure (CPAP) machine with a motor and an air pump, said first cabinet has a first opening on a first bottom surface or on a first side surface of said first cabinet adjacent to said first mattress, said openings intended to allow a hose attached to said CPAP machine to pass through the a surface of said first cabinet to a CPAP mask worn by a first user, said first cabinet suppressing noise generated by said motor and air pump thereby making said first sleeping area quieter and delivering said first processed air to said first user;

capturing said first processed air after it has flowed over said first mattress and down toward said floor through a plurality of cutouts in a top edge of a first hollow platform left wall and a first hollow platform right wall and a first hollow platform end wall of said first hollow platform outer box, said first processed air becoming a first return air;

pulling said first return air into a duct created between the opening between said first hollow platform outer box and a first set of three inner adjacent boxes and through a first left side filter assembly positioned on a first outer wall of said first left side box and a first right side filter assembly positioned on said first right side box;

pulling said first return air passed through said first left side filter assembly and said first right side filter assembly and introduced into said first center box to said first heat exchanger through a first plurality of openings in a first center box left side wall and a first center box right side wall of said first center box, said first return air pulled into said first center box by a lower pressure area created by said first supply fan intake end;

lowering at said first exhaust fan intake end pulling a first outside environment air through an outer duct tube of said first bidirectional duct to said first heat exchanger input end, through said first heat exchanger to said first exhaust fan output end, through a center duct tube of said first bidirectional duct of said first bidirectional duct to an outside environment.

4. The method of claim 3 where said first heat pump and said first supply fan and said first exhaust fan are controlled by said first wireless control module connected to said first heat pump and said first supply fan and said first exhaust fan and said first wireless control module contains a first bidirectional communication link to a first user's computing device executing a first software program.

5. The method of claim 3 whereby said first user controls said first heat pump and said first supply fan and said first exhaust fan through a first graphical interface from said first user's computing device to said first wireless control module, said first user's computing device presents said first graphical interface with a first graphical control elements allowing said first user to select an upper and lower range of temperature for a first processed air flowing through said first hollow headboard and over said first mattress and allowing said first user to select a start time and a stop time for said first supply fan and said first exhaust fan and said first heat pump to operate and, a first override control allowing said first user to turn on said first heat pump and said first supply fan and said first exhaust fan and said first override control allowing said user to turn-off said first heat pump and said first supply fan and said first exhaust fan.

6. The method of claim 3 where a night light fixture is mounted on said first hollow headboard and where said first night light fixture is communicably connected to said first wireless control module and said first night light fixture is controlled by said first user computing device, and said first user's computing device allows said first user to set a schedule of when said first night light fixture is turned on and turned off and a light emitted by said first night light fixture is set to a plurality of levels.

* * * * *